US007641526B1

(12) United States Patent
Bekker

(10) Patent No.: US 7,641,526 B1
(45) Date of Patent: Jan. 5, 2010

(54) VESSEL AND UNDERWATER MOUNTABLE AZIMUTHING THRUSTER

(75) Inventor: Joannes Raymond Mari Bekker, Houston, TX (US)

(73) Assignee: Thrustmaster of Texas, Inc., Houston, TX (US)

( * ) Notice: Subject to any disclaimer, the term of this patent is extended or adjusted under 35 U.S.C. 154(b) by 7 days.

(21) Appl. No.: 12/207,023

(22) Filed: Sep. 9, 2008

(51) Int. Cl.
*B63H 5/125* (2006.01)

(52) U.S. Cl. ..... 440/54

(58) Field of Classification Search ..... 114/144 B, 114/151; 440/53, 54
See application file for complete search history.

(56) References Cited

U.S. PATENT DOCUMENTS 2,987,027 A * 6/1961 Wanzer ..... 440/54
3,550,547 A * 12/1970 Pleuger et al. ..... 114/151
4,075,971 A * 2/1978 Reginensi et al. ..... 440/54
4,573,929 A * 3/1986 Savikurki et al. ..... 440/54
5,435,762 A * 7/1995 Reuter ..... 440/54
5,522,335 A * 6/1996 Veronesi et al. ..... 114/151
6,056,610 A * 5/2000 Fontanille ..... 440/54
6,375,524 B1 * 4/2002 Commandeur et al. ..... 440/54
6,439,936 B1 8/2002 Dreith et al.
6,458,004 B2 * 10/2002 Van Breems ..... 440/54
6,668,746 B1 12/2003 Schia et al.
6,848,380 B1 2/2005 Sainz
6,848,382 B1 2/2005 Bekker
7,055,447 B1 6/2006 Bekker

* cited by examiner

*Primary Examiner*—Lars A Olson
(74) *Attorney, Agent, or Firm*—Buskop Law Group, PC; Wendy Buskop

(57) ABSTRACT

A floating marine vessel, an azimuthing thruster assembly, and an underwater mountable azimuthing thruster, having a movable and removable canister and a double mechanical seal and bearings enabling atmospheric pressure lubricating fluid to lubricate the thruster and seal assembly. The moveable and removable canister support the azimuthing thrusters with a propeller shaft axis oriented downwards at an angle 95 degrees to 110 degrees from a rotatable thruster input shaft axis, for reducing thrusts losses due to friction between the propeller wash and the bottom hull of the vessel and reduces thruster to thruster interference when multiple thrusters are operating on the same vessel.

14 Claims, 4 Drawing Sheets

VESSEL AND UNDERWATER MOUNTABLE AZIMUTHING THRUSTER

FIELD

The embodiments relate to a floating marine vessel, an azimuthing thruster assembly, and an underwater mountable azimuthing thruster, having a movable and removable canister and a double mechanical seal and bearings enabling atmospheric pressure lubricating fluid to lubricate the thruster and seal assembly. The moveable and removable canister support the azimuthing thrusters with a propeller shaft axis oriented downwards at an angle 95 degrees to 110 degrees from a rotatable thruster input shaft axis, for reducing thrusts losses due to friction between the propeller wash and the bottom hull of the vessel and reduces thruster to thruster interference when multiple thrusters are operating on the same vessel.

BACKGROUND

A need exists for a watertight, versatile azimuthing thruster assembly that enables the thrusters to provide increased propulsion efficiency during their operations.

A need exists for a water tight seal in a azimuthing thruster, which doesn't require pressurized lubrication fluids, or complex pressure compensation systems.

A further need exists for a vessel and a thruster assembly for propelling a vessel with tilted azimuthing thrusters which are mounted with canisters for moving between an extended and a retracted position to increase propulsion efficiency.

The present embodiments meet these needs.

BRIEF DESCRIPTION OF THE DRAWINGS

The detailed description will be better understood in conjunction with the accompanying drawings as follows.

Figure 1:
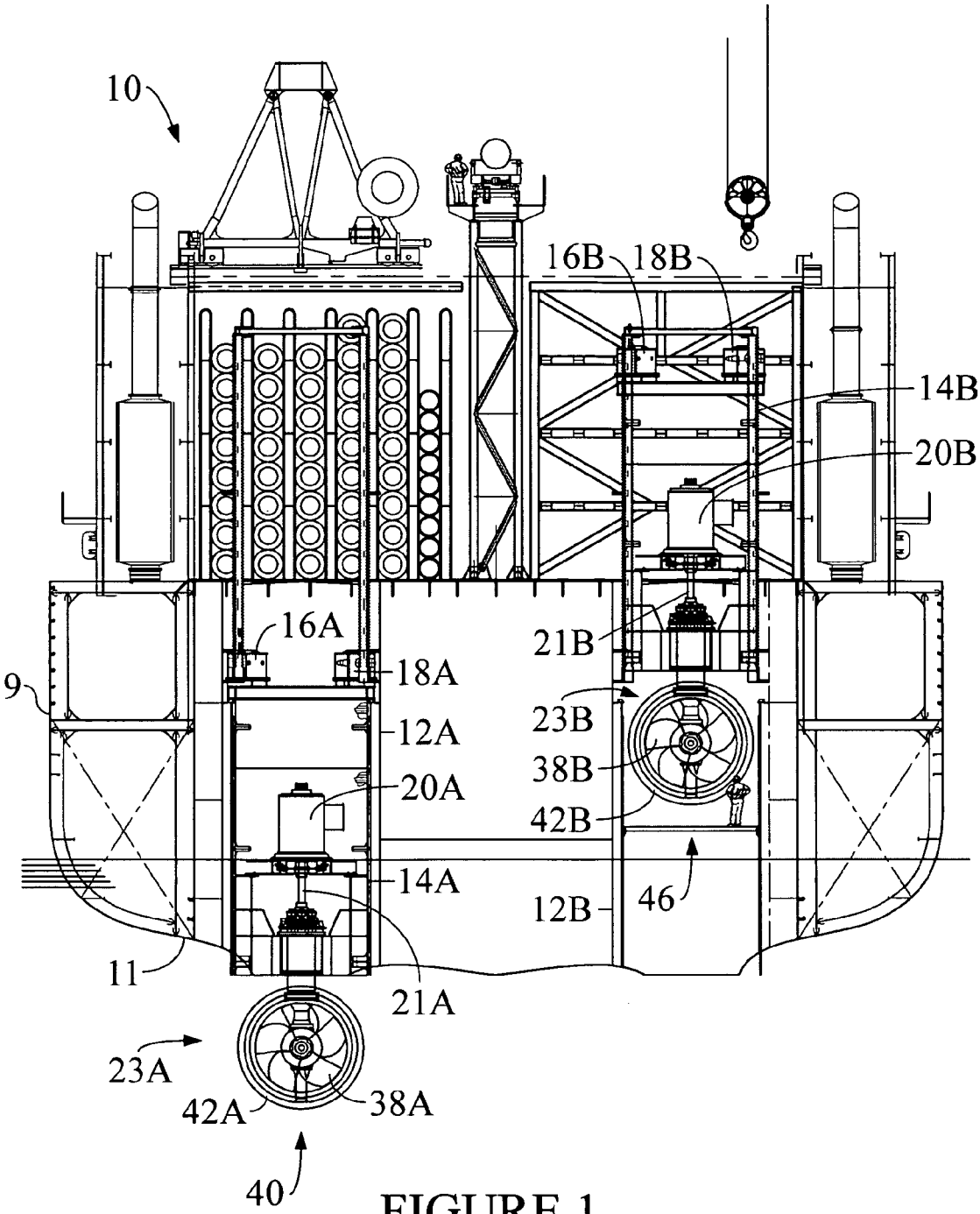
FIG. 1 shows a cross section of a floating marine vessel with two movable tilted thrusters.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to a floating marine vessel, an azimuthing thruster assembly and an underwater mountable azimuthing thruster, having a movable and removable canister and a double mechanical seal and bearings enabling atmospheric pressure lubricating fluid to lubricate the thruster and seal assembly.

The moveable and removable canister support the azimuthing thrusters with a propeller shaft axis oriented downwards at an angle 95 degrees to 110 degrees from a rotatable thruster input shaft axis directing propeller wash away from the bottom of the vessel and subsequent thrusters, which reduces thrust losses from friction of the propeller wash to the vessel bottom, through the coanda effect, and reduces thruster to thruster interference when multiple thrusters are operating on the same vessel.

Floating marine vessels often contain multiple thrusters arranged to extend from the bottom of the vessel's hull. These thrusters are arranged in pairs or in rows. When one thruster is placed directly in front of a second thruster, the second thruster loses efficiency due to the propeller wash from the front thruster. In one embodiment the present invention provides a slight downward tilt in each thruster to direct the propeller wash away from any subsequent thrusters.

In an embodiment, the azimuthing thrusters can be extended between a deployed position and retracted position. These thrusters can be connected to canisters, which can be removable and movable. The azimuthing thrusters can be affixed to the canisters, and can be removed as modular unit. This modular design provides a great advantage in the ease with which the thrusters can be removed for maintenance. This configuration can also be adapted for a water tight seal, which helps prevent corrosion and damage.

The canisters can be a multistory structure, supporting people and platforms on different levels. The canisters can be at least 1 story tall and up to 5 stories tall. The canister can contain a motor and means for turning the propeller of the azimuthing thrusters.

The azimuthing thruster can have a thruster housing with a double mechanical seal and a plurality of bearings forming a water tight seal, which prevents water from entering the thruster housing and lubricating oil from escaping. In an embodiment, the thruster can have a double mechanical seal enabling atmospheric pressure lubricating fluid to lubricate the thruster and seal assembly. This eliminates the need for pressurized lubricating oil seals and pressure compensation systems, which can form leaks. In this way the environment is better protected from lubricating oil leaks.

The floating marine vessel can be a semisubmersible drilling rig, a drill ship, a cruise ship, or any of a variety of vessels, and can include a barge. The azimuthing thruster assembly can have a deployed position wherein the bottom of the canister can be flush with the bottom of the hull. The propeller of the azimuthing assembly can extend several meters below the hull.

Turning now to the Figures, FIG. 1 illustrates a cross section of a floating marine vessel with two movable tilted thrusters.

A floating marine vessel (10) having a hull (9) and a hull bottom (11) is shown, with a first well (12*a*) and a second well (12*b*) formed in the hull (9). The first well (12*a*) and the second well (12*b*) can generally face downwards toward a sea floor (13). The first well (12*a*) and the second well (12*b*) can have depths of up to about 50 meters, or taller if needed. The well diameter can range between about 3 meter and 8 meters. The well can have several levels of platforms for supporting personnel.

A first moveable and removable canister (14*a*) can be mounted within the first well (12*a*) and a second moveable and removable canister (14*b*) can be mounted within the second well (12*b*). The first moveable and removable canister (14*a*) can be integrally connected to a first azimuthing thruster (23*a*) and the second moveable and removable canister can be integrally connected to a second azimuthing thruster (23*b*). The movable and removable canisters (14*a* and 14*b*) can be between about 3 meters to about 30 meters in height, have an inner diameter between about 2.5 meters to about 7 meters. The movable and removable canisters (14*a* and 14*b*) can support at least one platform for holding personnel. The moveable and removable canisters (14*a* and 14*b*) can be formed from steel or another rigid, material resistant to degradation at sea.

A first rack and pinion driver (16*a*) can secure the first movable and removable canister (14*a*) to one side of the first well (12*a*). A second rack and pinion drive (18*a*) can secure the first movable and removable canister (14*a*) to a different side of the first well (12*a*), allowing the first movable and removable canister (14*a*) with integral first azimuthing thruster (23*a*) integrally attached to be lowered to a deployed position (40) from a retracted position (46).

A third rack and pinion driver (16*b*) can secure a second movable and removable canister (14*b*) to a first side of the second well (12*b*). A fourth rack and pinion drive (18*b*) can secure the second movable and removable canister (14*b*) to a second side of the second well (12*b*), allowing the second canister with and integral second azimuthing thruster (23*b*) integrally attached to be lowered to a deployed position (40) from a retracted position (46). In this Figure, two azimuthing thrusters are down, thruster (23*a*) is shown in the deployed position (40) and thruster (23*b*) is shown in the retracted position (46).

A first electric motor (20*a*) is shown in the first movable and removable canister (14*a*) for driving the first azimuthing thruster (23*a*). The first electric motor (20*a*) engages a first rotatable connecting shaft (21*a*), which can be connected to a propeller shaft of the first azimuthing thruster (23*a*). The second electric motor (20*b*) is shown in the second movable and removable canister (14*b*) engaging a second rotatable connecting shaft (21*b*), where the second rotatable connecting shaft (21*b*) ultimately engages a propeller shaft of the second azimuthing thruster (23*b*). The rotatable connecting shafts (21*a* and 21*b*) can have diameters from about 6 centimeters to about 1 meter, and have lengths from about 1 meter to about 10 meters. The rotatable connecting shafts (21*a* and 21*b*) can be hollow or solid. The electric motors (20*a* and 20*b*) can be AC variable speed electric motors from ABB, Seimens or Westinghouse, and can have capacity from about 1 megawatt to about 10 megawatts.

Each azimuthing thruster (23*a* and 23*b*) can have a propeller (38*a* and 28*b*) and a nozzle (42*a* and 42*b*).

Figure 2A:
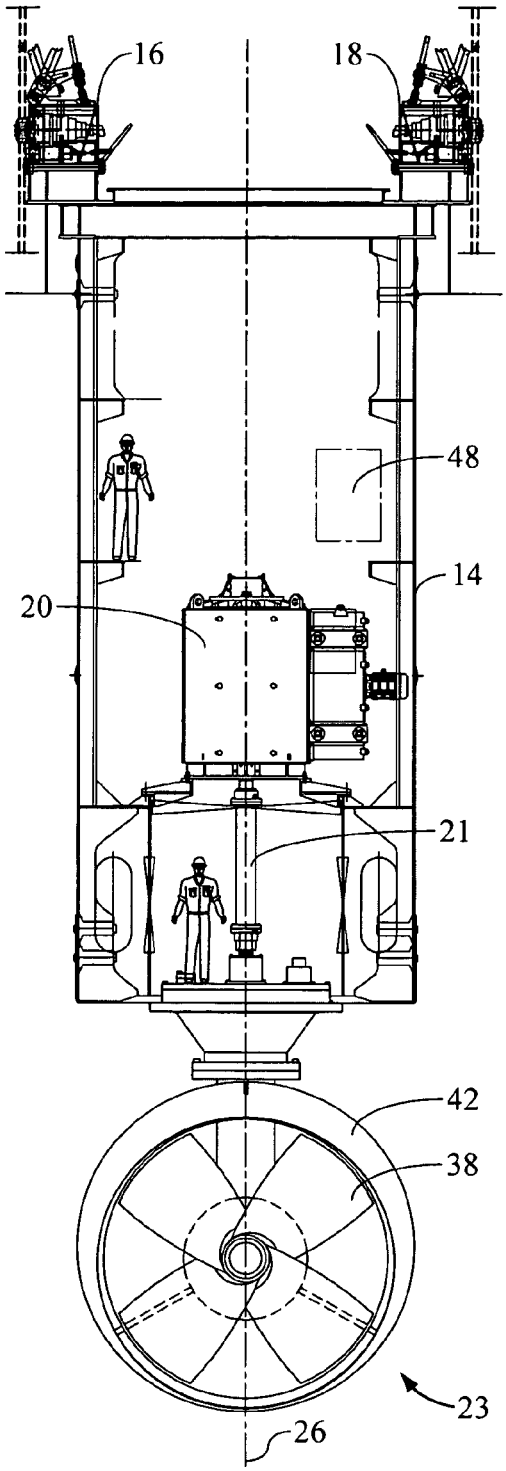
FIG. 2A shows a front cross section of an azimuthing thruster assembly.

FIG. 2A illustrates a front cross section of an azimuthing thruster assembly, which can include an azimuthing thruster (23) mounted with a movable and removable canister (14). A first and second rack and pinion drive (16 and 18), which can be deployed on either side of the movable and removable canister (14) for raising and deploying the azimuthing thruster assembly with in a well.

An electric motor (20) is illustrated within the movable and removable canister (14) engaging a rotatable connecting shaft (21). A rotatable thruster input shaft (22), which can be seen in FIG. 3, with rotatable thruster input shaft axis (26), engages the rotatable connecting shaft (21) for receiving power from the electric motor (20).

A hydraulic power unit (48) can also be seen which can drive the rack and pinion drives (16 and 18) for retracting and extending the movable and removable canister (14). The hydraulic power unit can have a capacity from about 20 Kw to about 250 Kw.

Figure 2B:
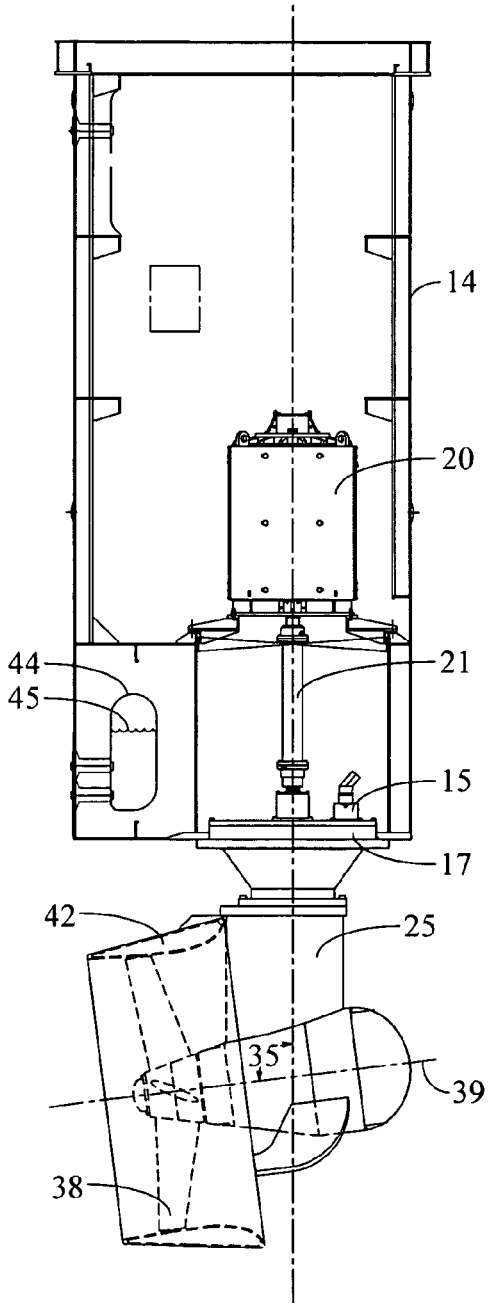
FIG. 2B shows a side view cross section of an azimuthing thruster assembly.

FIG. 2B is a side view cross section of an azimuthing thruster assembly. In this view the movable and removable canister (14) of FIG. 2A is depicted with the electric motor (20) engaging a rotatable connecting shaft (21). The rotatable connecting shaft (21) connects to a rotatable thruster input shaft (22), which is contained within a thruster housing (25), and can be seen in FIG. 3. Within the thruster housing (25), a pinion gear (24), which can be seen in FIG. 3, connects to the rotatable thruster input shaft (22) and to a bull gear (30), also seen in FIG. 3, for transferring the rotation of the of the rotatable thruster input shaft (22) to the bull gear (30). The bull gear (30) connects to the propeller shaft (32), which is partially within the thruster housing (25) and can best be seen in FIG. 3. The propeller shaft (32) has a propeller shaft axis (39) for further transferring the rotation of the rotatable thruster input shaft (22) to the propeller shaft (32). The propeller (38) engages the propeller shaft (32) on one end and is tilted at a downward angle (35). The downward angle (35) in this view is about 97 degrees from the rotatable thruster input shaft axis (39).

The thruster housing (25) can be made from steel, or a composite that is sturdy and impact resistant. In one embedment, the thruster housing can be sealed and can be water and oil tight. This can be accomplished with a seal and bearings within the thruster housing.

A lubricating tank (44) can be seen in FIG. 2B located within the movable and removable canister (14). The lubricating tank (44) can contain atmospheric pressure lubricating fluid (45), which can be supplied to bearings and seals within the thruster housing (25) at atmospheric pressure. This lubricating fluid is at atmospheric pressure because of a double mechanical seal, seen in FIG. 3, which eliminates the need for pressurized lubrication fluids and/or pressure compensation systems which are subject to mechanical failures.

The lubricating tank (44) can hold between about 50 gallons to about 1,000 gallons of atmospheric pressure lubricating fluid (45). The atmospheric pressure lubricating fluid (45) can be lube oil, or a similar atmospheric pressure lubricating fluid that passes the shrimp test. High quality gear oils enable these thrusters to be environmentally friendly at sea.

A slewing drive (15) and a slewing bearing (17) are shown for steering the azimuthing thruster assembly. In an embodiment, the azimuthing thruster (23) can include between about 1 slewing drive to about 5 slewing drives (15) that can steer the thruster through 360 degrees. These slewing drives (15) can be hydraulic or electrically powered. The slewing drives (15) can rotate the azimuthing thruster at a speed of about 2 rpm in an embodiment. Slewing drives (15) can be made by Brevini, Eskridge or a similar manufacturer. The slewing drives engage a slewing bearing (17) which can be mounted with the thruster housing for steering the azimuthing thruster (23). A slewing bearing can be purchased from Rote Erde of Germany.

A nozzle (42) can surround the propeller (38) and can be connected to the thruster housing (25). The nozzle (42) can be tapered slightly to focus the wash of the propeller while orienting during steerage of the azimuthing thruster. For example, it can be desirable to further direct the propellant wash of the azimuthing thruster (23) downwards and away from the bottom surface of the vessel or away from a second azimuthing thruster. In an embodiment, the nozzle (42) can be tapered nozzle, such as those made by Kort of Germany. The nozzle (42) can be made and formed from steel or stainless steel.

Figure 3:
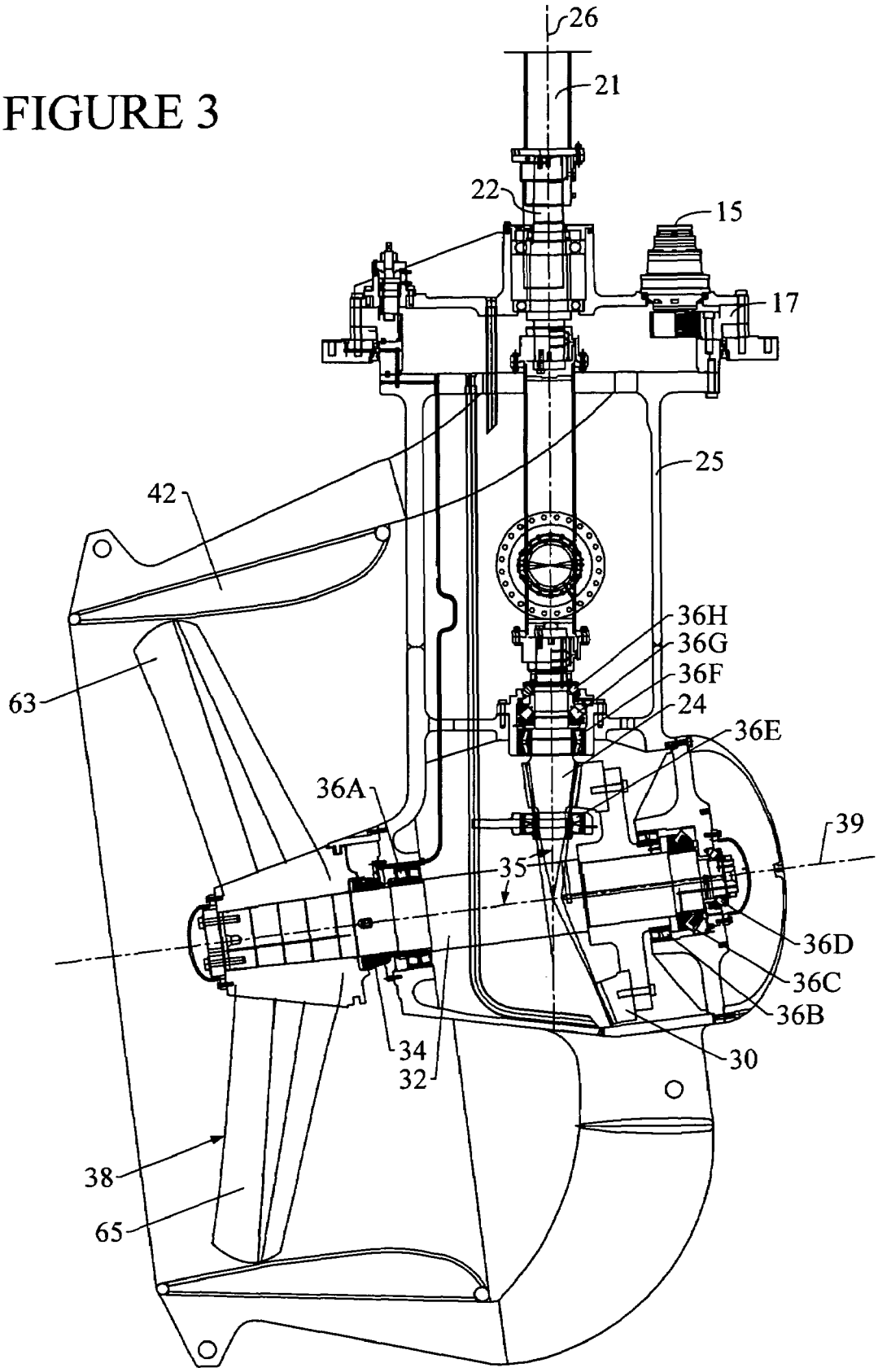
FIG. 3 shows a cross-section detail of the azimuthing thruster.

FIG. 3 shows a cross section detail of the azimuthing thruster (23). The rotatable connecting shaft (21) is shown at the top of the figure and connects the rotatable thruster input shaft (22) having a rotatable thruster input shaft axis (26). The rotatable thruster input shaft (22) enters the thruster housing (25), which maintains a substantially water tight seal with a plurality of bearings, (36*a*, 36*b*, 36*c*, 36*d*, 36*e*, 36*f*, 36*g*, and 36*h*) and a double mechanical seal (34).

The rotatable thruster input shaft (22) can connect to the pinion gear (24) inside the thruster housing (25). The bull gear (30) can connect to the pinion gear (24) on the side of the propeller shaft (32) opposite the propeller (38). The pinion gears (24) and bulls gears (30) can be made Klingelnberg of Germany.

The propeller (38) is depicted having a 4 blade design, although only two blades (63 and 65) are shown. The propeller shaft (32) can be capped for a secure watertight engagement. The propeller (38) can have between about 4 blades to about 6 blades, which can be connected to the propeller shaft (32) on the exterior of the thruster housing (25). The propeller shaft (32) can have a propeller shaft axis (34) which can be oriented between about 95 degrees to about 110 degrees from the rotatable thruster input shaft axis at a downward angle (35). This orientation provides the azimuthing thruster with a slight tilt. The propeller can be adapted to extend below adjacent submerged surfaces of the floating marine vessel when the movable and removable canister is in the deployed position (40).

In an embodiment, the azimuthing thruster can have sacrificial zinc forming an anode secured to the skeg on the outer periphery of the nozzle (42).

In an embodiment, a lock can be used to secure the movable and removable canister in a specified position.

The seal can be a double mechanical seal, such dual face seals with silicon carbide faces provided by Thrustmaster of Texas, Inc., based in Houston, Tex.

Figure 4:
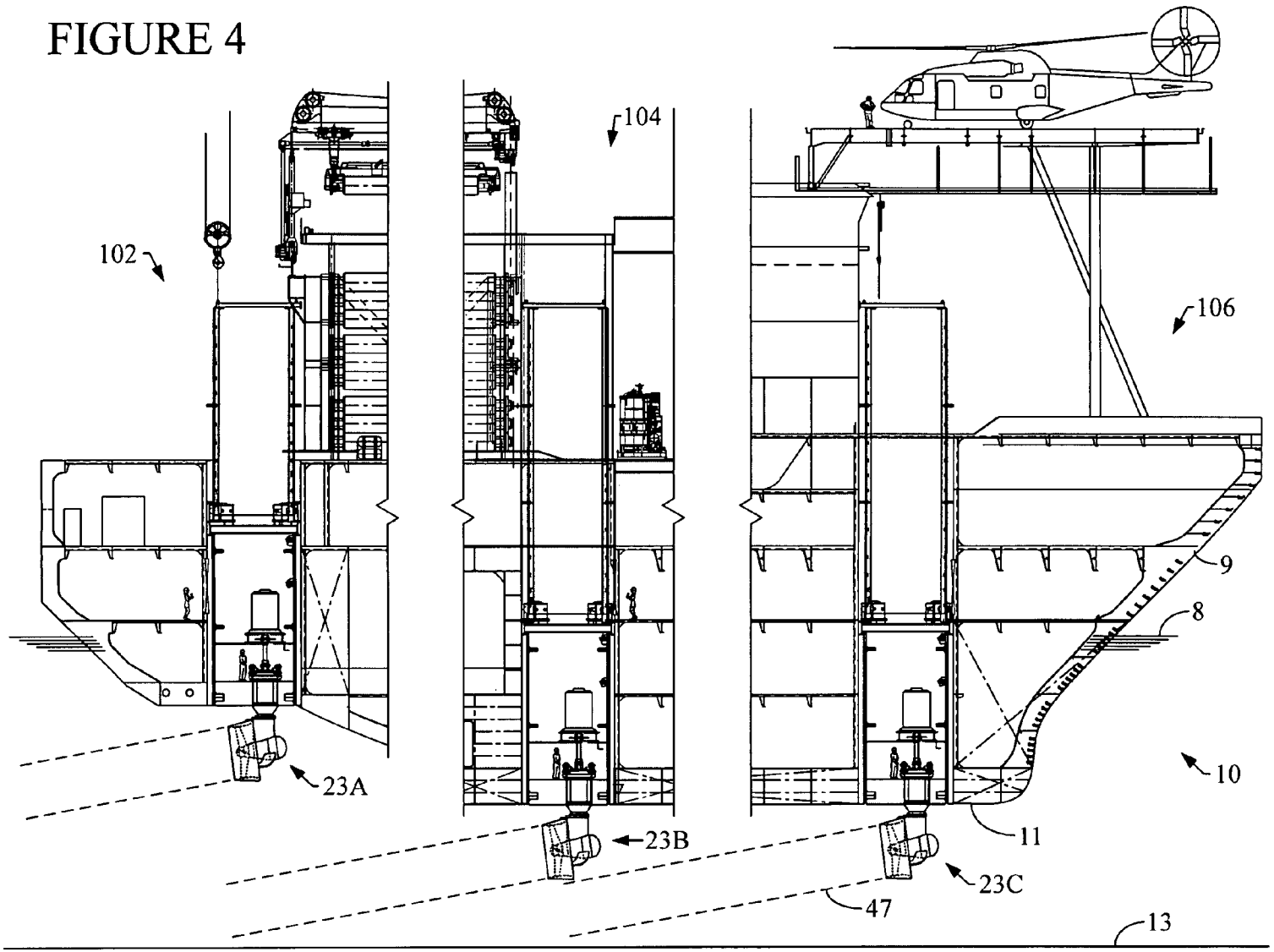
FIG. 4 shows in cross section of two deployed azimuthing thrusters.

FIG. 4 shows a broken cross section of the vessel (10) having a hull (9) with a hull bottom (11). Below the waterline (8) the vessel (10) can be seen with a first section of the vessel (102) having a first azimuthing thruster (23*a*), a second section of the vessel (104) having a second azimuthing thruster (23*b*) and a third section of the vessel (106) having a third azimuthing thruster (23*c*). Each azimuthing thruster (23 *a*, 23*b* and 23*c*) can be seen facing the rear of the vessel (10) and having a propeller wash (47). The propeller wash (47) of the third azimuthing thruster (23*c*) can be seen focused downward and away from the subsequent azimuthing thruster (23*b*). FIG. 4 further illustrates the flow of the propeller wash (47) from each of the azimuthing thrusters (23*a*, 23*b* and 23*c*) which can be seen directed slightly down ward to avoid both interfering either subsequent azimuthing thrusters and the hull bottom (11).

While these embodiments have been described with emphasis on the embodiments, it should be understood that within the scope of the appended claims, the embodiments might be practiced other than as specifically described herein.

What is claimed is:

1. A floating marine vessel comprising:

a. a hull having a hull bottom;

b. at least one well in the hull oriented toward a sea floor;

c. a movable and removable canister disposed in each well;

d. at least two rack and pinion drives connected to each movable and removable canister, disposed in the well for moving each movable and removable canister between a deployed position and a retracted position;

e. an electric motor disposed within each movable and removable canister, each electric motor connected to a rotatable connecting shaft;

f. a rotatable thruster input shaft with a rotatable thruster input shaft axis connected to each rotatable connecting shaft, removably connected within each movable and removable canister;

g. an azimuthing thruster removably connected to each movable and removable canister comprising:

(i) at least one slewing drive for each azimuthing thruster, wherein the at least one slewing drive engages a slewing bearing for steering each azimuthing thruster;

(ii) a thruster housing;

(iii) a pinion gear in the thruster housing connected to the thruster input shaft;

(iv) a bull gear in the thruster housing connected to the pinion gear;

(v) a propeller shaft with a propeller shaft axis at least partially within the thruster housing, wherein the propeller shaft further engages the bull gear;

(vi) a seal and a plurality of bearings within the thruster housing wherein the seal provides a watertight and oil tight seal for the propeller shaft;

(vii) a propeller connected to each propeller shaft wherein each propeller is external to the thruster housing; wherein the propeller shaft axis is oriented at a downward angle 95 degrees to 110 degrees from the rotatable thruster input shaft axis to reduce the thrust losses from friction of the propeller wash to the vessel bottom, through the coanda effect, and to reduce thruster to thruster interference caused by propeller wash; and (viii) a nozzle disposed around each propeller further connected to each thruster housing for focusing propeller wash;

h. a lubricating tank at atmospheric pressure in each movable and removable canister; and i. an atmospheric pressure lubricating fluid disposed within each lubricating tank, further wherein each lubricating tank supplies atmospheric pressure lubricating fluid to each thruster and bearings.

2. The floating marine vessel of claim 1, wherein the seal is a double mechanical seal.

3. The floating marine vessel of claim 1, wherein in that the vessel is a ship, a semisubmersible drilling rig, a drill ship, a cruise ship or a barge.

4. The floating marine vessel of claim 1, wherein the vessel is equipped as an offshore drilling facility.

5. The floating marine vessel of claim 1, wherein the propeller comprises between 2 blades and 6 blades.

6. The floating marine vessel of claim 1, wherein each rack of each rack and pinion drive is attached to the vessel, and each pinion of each rack and pinion drive is mounted on top of the movable and removable canister to facilitate moving the movable and removable canister between a deployed position and a retracted position.

7. The floating marine vessel of claim 6, wherein the rack and pinion drives are hydraulic, electric or combinations thereof.

8. An underwater mountable azimuthing thruster assembly comprising:

a. a movable and removable canister for use in a well of a vessel;

b. at least two rack and pinion drives connected to the movable and removable canister disposed in the well for moving the movable and removable canister between a deployed position and a retracted position;

c. an electric motor disposed within each movable and removable canister, wherein the electric motor is connected to a rotatable connecting shaft;

d. a rotatable thruster input shaft with a rotatable thruster input shaft axis connected to the rotatable connecting shaft removably connected within each movable and removable canister;

e. an azimuthing thruster removably connected to each movable and removable canister comprising:

(i) at least one slewing drive engaging a slewing bearing for steering the azimuthing thruster;

(ii) a thruster housing;

(iii) a pinion gear in the thruster housing connected to the thruster input shaft;

(iv) a bull gear in the thruster housing connected to the pinion gear;

(v) propeller shaft with a propeller shaft axis at least partially within the thruster housing wherein the propeller shaft further engages the bull gear;

(vi) a seal and a plurality of bearings disposed within the thruster housing wherein the seal provides a watertight and oil tight seal for the propeller shaft;

(vii) a propeller connected to each propeller shaft wherein each propeller is external to the thruster housing; wherein the propeller shaft axis is oriented at a downward angle 95 degrees to 110 degrees from the rotatable thruster input shaft axis to reduce the thrust losses from friction of the propeller wash to the vessel bottom, through the coanda effect, and to reduce thruster to thruster interference caused by propeller wash; and (viii) a nozzle disposed around the propeller further connected to the thruster housing for focusing propeller wash; and f. a lubricating tank at atmospheric pressure in the movable and removable canister; and g. an atmospheric pressure lubricating fluid disposed within the lubricating tank, further wherein the lubricating tank supplies atmospheric pressure lubricating fluid to the thruster and bearings.

9. The underwater mountable azimuthing thruster assembly of claim 8, wherein the propeller comprises between 2 blades and 6 blades.

10. The underwater mountable azimuthing thruster assembly of claim 8, wherein the seal is a double mechanical seal.

11. The underwater mountable azimuthing thruster assembly of claim 8, wherein the rack and pinion drives are hydraulic, electric or combinations thereof.

12. An underwater mountable azimuthing thruster comprising:

a. at least one slewing drive engaging a slewing bearing for steering the azimuthing thruster;

b. a thruster housing;

c. a pinion gear in the thruster housing, connected to the thruster input shaft;

d. a bull gear within the thruster housing connected to the pinion gear;

e. a propeller shaft with a propeller shaft axis at least partially within the thruster housing, wherein the propeller shaft further engages the bull gear;

f. a seal and a plurality of bearings within the thruster housing wherein the seal provides a watertight and oil tight seal for the propeller shaft;

g. a propeller connected to the propeller shaft wherein the propeller shaft is external to the thruster housing, and wherein the propeller shaft axis is oriented at a downward angle between 95 degrees to 110 degrees from the rotatable thruster input shaft axis to reduce the coanda effect of a first propeller wash from a second propeller wash of two adjacent thruster system, and the propeller is adapted to extend below the hull of the floating marine vessel when the movable and removable canister is in the deployed position;

h. a nozzle disposed around the propeller connected to the thruster housing for focusing propeller wash; and i. a lubricating tank at atmospheric pressure in the moveable and removable canister; and j. an atmospheric pressure lubricating fluid disposed within the lubricating tank, further wherein each lubricating tank supplies atmospheric pressure lubricating fluid to each thruster and bearings.

13. The underwater mountable azimuthing thruster of claim 12, wherein the propeller comprises between 2 blades and 6 blades.

14. The underwater mountable azimuthing thruster of claim 12, wherein the seal is a double mechanical seal.

* * * * *